US010126693B2

(12) United States Patent
Akiba

(10) Patent No.: US 10,126,693 B2
(45) Date of Patent: Nov. 13, 2018

(54) IMAGE FORMING APPARATUS WITH TECHNOLOGY FOR SENDING COMMAND IN TIMELY MANNER

(71) Applicant: CANON KABUSHIKI KAISHA, Tokyo (JP)

(72) Inventor: Kazuhiro Akiba, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 105 days.

(21) Appl. No.: 15/285,087

(22) Filed: Oct. 4, 2016

(65) Prior Publication Data

US 2017/0115612 A1 Apr. 27, 2017

(30) Foreign Application Priority Data

Oct. 23, 2015 (JP) ..... 2015-209178

(51) Int. Cl.
*G03G 15/00* (2006.01)

(52) U.S. Cl.
CPC ..... *G03G 15/50* (2013.01)

(58) Field of Classification Search
CPC ..... G03G 15/50
USPC ..... 399/82
See application file for complete search history.

(56) References Cited

U.S. PATENT DOCUMENTS 8,284,227 B2 10/2012 Nomura ..... 347/234
2013/0328987 A1* 12/2013 Shoji ..... G03G 15/043 347/118

FOREIGN PATENT DOCUMENTS

JP 2009-126002 6/2009
JP 2011-104959 6/2011

* cited by examiner

*Primary Examiner* — Billy Lactaoen
(74) *Attorney, Agent, or Firm* — Fitzpatrick, Cella, Harper & Scinto

(57) ABSTRACT

An image forming apparatus comprises a first control unit and a second control unit. The second control unit is connected to the first control unit and controls a light source according to a video signal received from the first control unit. The first control unit generates a video signal according and commands, stores the commands, and sends commands according to an order of earliest to latest execution timing. The second control unit receives the video signal and the commands, generates a drive signal according to the video signal and the commands and drives the light source.

13 Claims, 10 Drawing Sheets

FIG. 5A

500

| 501 | 502 | 503 | 504 |
|---|---|---|---|
| REFLECTION PAGE | REFLECTION LINE | CONTROL TARGET | CONTROL CONTENT |

FIG. 5B

| | 501 | 502 | 503 | 504 |
|---|---|---|---|---|
| | REFLECTION PAGE | REFLECTION LINE | CONTROL TARGET | CONTROL CONTENT |
| 611 | 2 | 200 | MAIN SCANNING MAGNIFICATION | 101% |
| 612 | 3 | 0 | MAIN SCANNING MAGNIFICATION | 98% |
| 613 | 2 | 150 | LASER POWER | F0h |

IMAGE FORMING APPARATUS WITH TECHNOLOGY FOR SENDING COMMAND IN TIMELY MANNER

BACKGROUND OF THE INVENTION

Field of the Invention

The present invention relates to technology sending a command in a timely manner within an image forming apparatus.

Description of the Related Art

Scanning light is known to bend due to tilting of an optical system provided in an exposure unit of an image forming apparatus. Such bending can be corrected by creating profile data in advance, and driving a laser according to the profile data (see Japanese Patent Laid-Open No. 2009-126002, and Japanese Patent Laid-Open No. 2011-104959).

Incidentally, increased speed of an electrophotographic printer engine is realized by introducing multibeam exposure by a plurality of laser diodes. However, because respective control signals are necessary for the plurality of laser diodes, there is an increase in control signal lines and video signal lines. Consequently, it is conceivable to use a common line for a control signal line and a video signal line. This can be realized by connecting a video ASIC that outputs a video signal, and a PWM-IC that generates a PWM signal from a video signal that has been input and outputs the generated PWM signal to a laser driver (referred to below as an LD), in a high-speed serial communication scheme. The letters ASIC are an abbreviation for 'application specific integrated circuit'. The letters PWM are an abbreviation for 'pulse width modulation'. In a serial communication scheme, a video signal is sent in a period in which laser light is scanning an image area, and a control signal is sent in a period in which laser light is not scanning the image area. Thus, in a period corresponding to a non-image area, a laser power adjustment value, a shading correction amount, magnification information of a main scanning direction, or the like are transmitted as a control command. However, a plurality of control parameters such as a laser power adjustment value are each asynchronously calculated, loaded on a control command, and sent, so a serial communication scheme results in new problems. When a serial communication scheme and a multibeam light source are introduced, there are cases where send timing conflicts between a plurality of control commands. As a result, it is also conceivable that a control command arrives at the PWM-IC later than a timing when the control command is to be used in the PWM-IC. Therefore, it may not be possible for the PWM-IC to execute PWM control as intended.

SUMMARY OF THE INVENTION

The present invention transmits a plurality of control commands in an order corresponding to their respective execution timing.

The present invention provides an image forming apparatus comprising the following elements. A light source. An image carrier. A scanning unit is configured to deflect a light beam output from the light source such that the light beam scans the image carrier. A first control unit is configured to execute control related to a video signal. A second control unit is connected to the first control unit by a communication line, and is configured to control the light source according to a video signal received from the first control unit. The first control unit has a video signal generation unit configured to generate a video signal according to image information, a command generation unit configured to generate a command for transmitting a control parameter used to control the light source, a storage unit configured to store a command generated by the command generation unit, and a sending unit configured to send each of a plurality of commands stored in the storage unit according to an order of earliest to latest execution timing through the communication line. The second control unit has: a receiving unit configured to receive the video signal and the command through the communication line, and a drive unit configured to generate a drive signal according to the video signal and the command received by the receiving unit and drive the light source.

Further features of the present invention will become apparent from the following description of exemplary embodiments (with reference to the attached drawings).

BRIEF DESCRIPTION OF THE DRAWINGS

FIGS. 5A and 5B show a control command format.

DESCRIPTION OF THE EMBODIMENTS

Image Forming Apparatus

Figure 1:
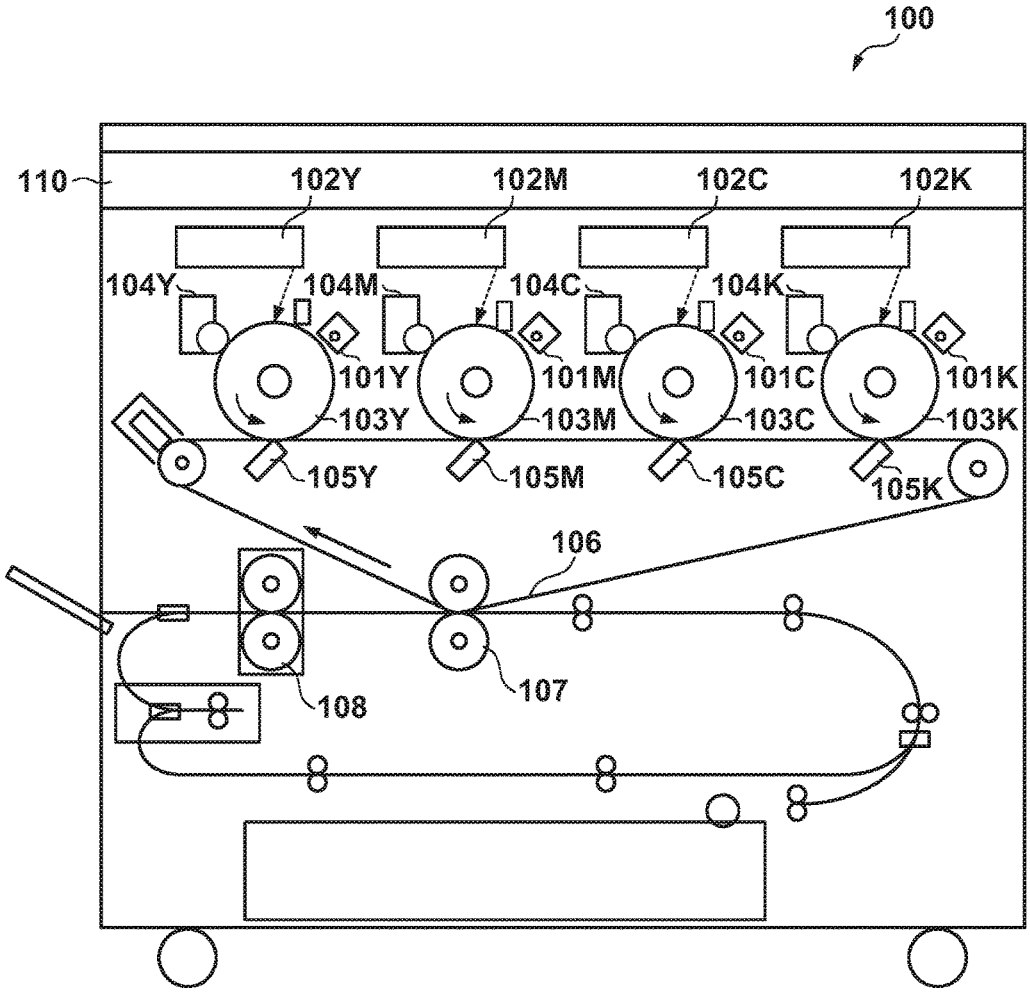
FIG. 1 is a schematic cross-sectional view showing an image forming apparatus.

A schematic configuration of an image forming apparatus will be described with reference to FIG. 1. An image forming apparatus 100 is a color copier employing a four drum system in which four photoreceptors are arranged in tandem. In the below description, the characters YMCK indicate toner colors of yellow, magenta, cyan, and black. Note that the characters YMCK are omitted when describing items that are common to the four colors.

A photosensitive drum 103 is an image carrier that carries an electrostatic latent image or a toner image. A charger 101 charges the surface of the photosensitive drum 103 to a uniform electric potential. A laser scanner 102 exposes the photosensitive drum 103 according to a drive signal corresponding to image information that was generated by an original reading unit 110, thus forming an electrostatic latent image. The laser scanner 102 is one example of a scanning unit that, such that a light beam that has been output from a light source scans the photosensitive drum 103, deflects the light beam, and is also referred to as an exposure unit or an optical scanning apparatus. A development unit 104 uses toner to develop an electrostatic latent image and form a toner image. A first transfer bias blade 105 is a transfer unit that transfers a toner image to an intermediate transfer belt (ITB) 106. Multiple transfer of respective toner images of different colors is performed by respective image forming units of the colors YMCK, thereby forming a multicolor image on the ITB 106. A second transfer bias roller 107 is a transfer unit that transfers a multicolor image being carried on the ITB 106 onto a sheet. A fixing apparatus 108 applies heat and pressure to the sheet and the multicolor image to fix the multicolor image.

Laser Scanner

Figure 2:
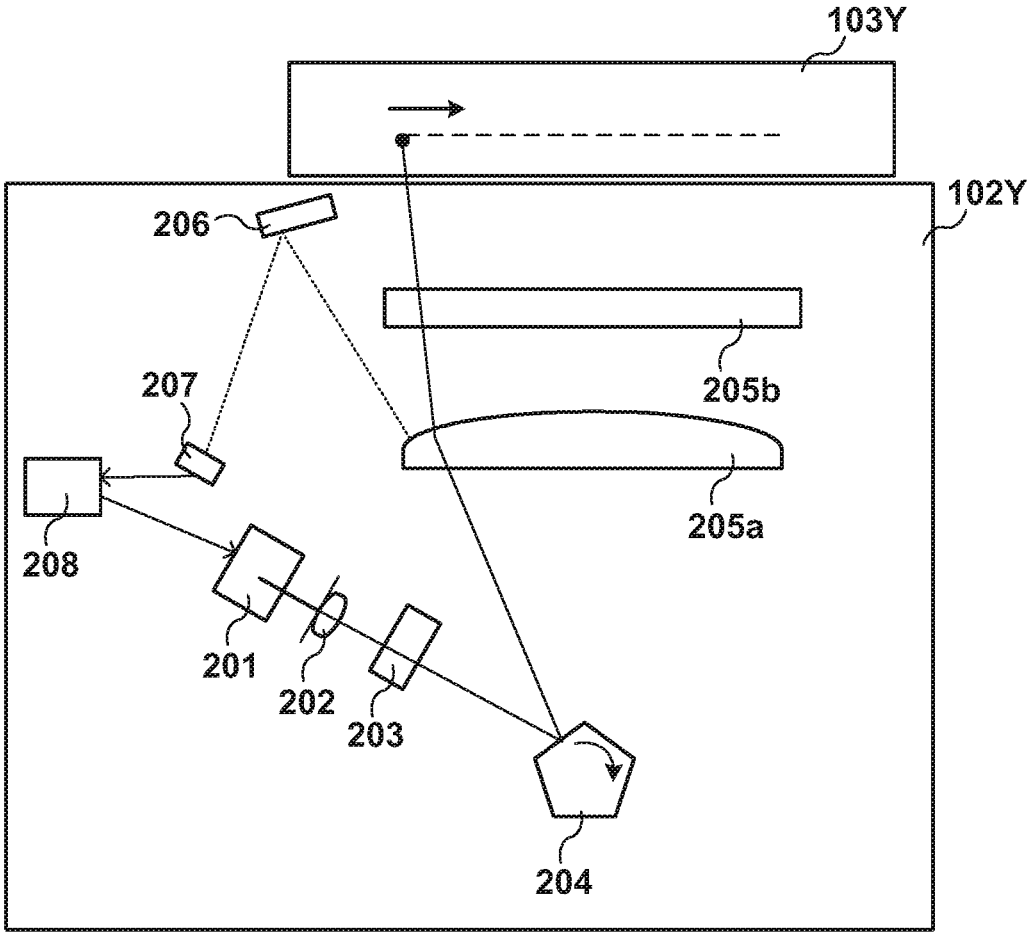
FIG. 2 is a schematic view showing a laser scanner.

The laser scanner 102 will be described with reference to FIG. 2. By irradiating four laser beams, the laser scanner 102 simultaneously renders four beams of main scanning light. Laser scanners 102Y, 102M, 102C, and 102K have the same internal configuration, so the laser scanner 102Y will be described.

The laser scanner 102Y has a light source 201, a collimator lens 202, a cylindrical lens 203, a polygonal mirror 204, scanning lenses 205*a* and 205*b*, a folding mirror 206, a BD sensor 207, and a laser scanner control unit 208. The letters BD are an abbreviation for 'beam detection' (light beam detection). The collimator lens 202, the cylindrical lens 203, and the polygonal mirror 204 are disposed in front of the light source 201. Laser light that has been output from the light source 201 is converted to parallel light by the collimator lens 202, focused in a sub-scanning direction by the cylindrical lens 203, and then incident on the polygonal mirror 204. By the polygonal mirror 204 rotating at high speed in a clockwise direction, laser light scans on the photosensitive drum 103Y (main scanning). Sub-scanning is realized by rotation of the photosensitive drum 103Y. By passing through the scanning lenses 205*a* and 205*b*, which have fθ properties, laser light that has been reflected by the polygonal mirror 204 scans on the photosensitive drum 103Y at a constant speed.

The folding mirror 206 is disposed at a position where laser light that has passed through an end of the scanning lens 205*b* is incident. Laser light reflected by the folding mirror 206 is incident on the BD sensor 207. That is, after being incident on the BD sensor 207, the laser light scans on the photosensitive drum 103Y. When the BD sensor 207 detects laser light, the BD sensor 207 outputs a BD signal (pulse) to the laser scanner control unit 208. The laser scanner control unit 208 controls rotational speed of the polygonal mirror 204 as a reference for BD signal input timing, and controls write-out timing of laser light on the photosensitive drum 103Y. The light source 201 has four laser diodes (LD).

The polygonal mirror 204 is a rotating polygonal mirror, and has a plurality of reflective faces. There is variation in a face incline (incline of a reflective face relative to the rotational axis of the polygonal mirror 204) and reflectivity of the plurality of reflective faces. It is also necessary to adjust control parameters according to sheet type. For example, it is necessary to adjust control parameters such as laser power, shading correction in the main scanning direction, or main scanning magnification, for each line or for each page. By controlling laser power, the laser scanner control unit 208 reduces laser light variation between scan lines on the photosensitive drum 103Y, caused by variation in reflectivity between faces of the polygonal mirror 204. The laser scanner control unit 208 executes shading correction in the main scanning direction by controlling laser power. When doing so, a main scanning area on the photosensitive drum 103Y is divided into a plurality of blocks (areas), and the laser power is controlled in block units. The laser scanner control unit 208 corrects main scanning magnification according to variation in length in the main scanning direction of each face of the polygonal mirror 204. Thus, the length of each main scanning line on the photosensitive drum 103Y is uniformly controlled. The main scanning magnification is changed by adjusting the frequency of a pixel clock that controls an exposure range of a single pixel. The pixel clock can be used as an operation clock of the PWM-IC described later.

In duplex printing, the laser scanner control unit 208 reduces the main scanning magnification of a second face to less than the main scanning magnification of a first face. In a case where the sheet material is paper, moisture in the paper escapes when performing heat fixing, so the size of the sheet temporarily contracts. Consequently, by reducing the main scanning magnification of the second face to less than the main scanning magnification of the first face, the main scanning magnification of an image of the first face matches the main scanning magnification of an image of the second face after the sheet has returned to the original size.

Thus, control of the laser scanner 102Y includes control in line units resulting from faces of the polygonal mirror 204, and control in page units for changing the main scanning magnification in duplex printing.

Controller

Figure 3:
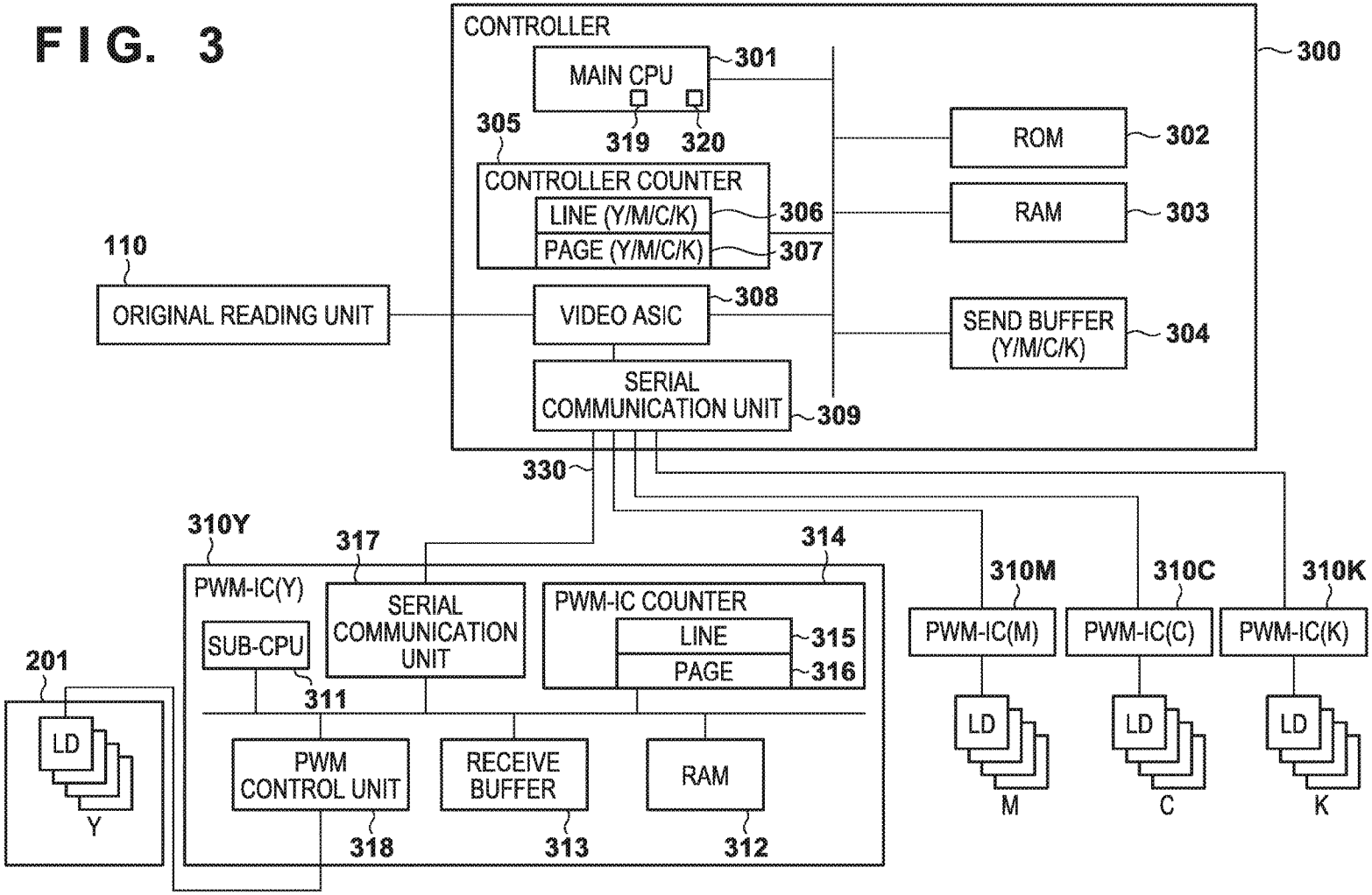
FIG. 3 is a block diagram showing a control system.

A control system of the image forming apparatus 100 will be described with reference to FIG. 3. A controller 300 is an example of a first control unit that executes control related to a video signal. The controller 300 generates a video signal corresponding to image information output from the original reading unit 110, and sends the generated video signal to a PWM-IC 310. A main CPU 301 is a processor that calculates an adjustment value of laser power, main scanning magnification, or the like suitable for image forming based on a BD signal or an ambient temperature acquired from a temperature sensor not shown in the drawings, and issues a control command including the adjustment value. A command generation unit 319 of the main CPU 301 functions as a command generation unit that generates a command for transmitting a control parameter used in order to control the light source 201. A ROM 302 is a storage apparatus that stores a program of the main CPU 301. A RAM 303 is a work memory of the main CPU 301, and is used when calculating an adjustment value. A send buffer 304 temporarily holds a control command that has been issued by the CPU 301 before the control command is sent to the PWM-IC 310. That is, the send buffer 304 is a storage unit that stores a command that has been generated by the command generation unit 319, and functions as a holding unit that holds, or an accumulation unit that accumulates. The main CPU 301 stores the control command in the send buffer 304 without directly transferring the control command to a video ASIC 308.

A sorting unit 320 of the main CPU 301 functions as a sorting unit that sorts a plurality of commands stored in the send buffer 304 according to an order of earliest to latest execution timing of each command. Also, the sorting unit 320 has a creation unit that creates a linear list for storing the plurality of commands in the send buffer 304 according to the execution timing of each command.

The video ASIC 308 is an example of a video signal generation unit that generates a video signal according to image information. For example, the video ASIC 308 converts image information acquired from the original reading unit 110 to a video signal, and sends the video signal together with a control command read out from the send buffer 304 to the PWM-IC 310.

Figure 4:
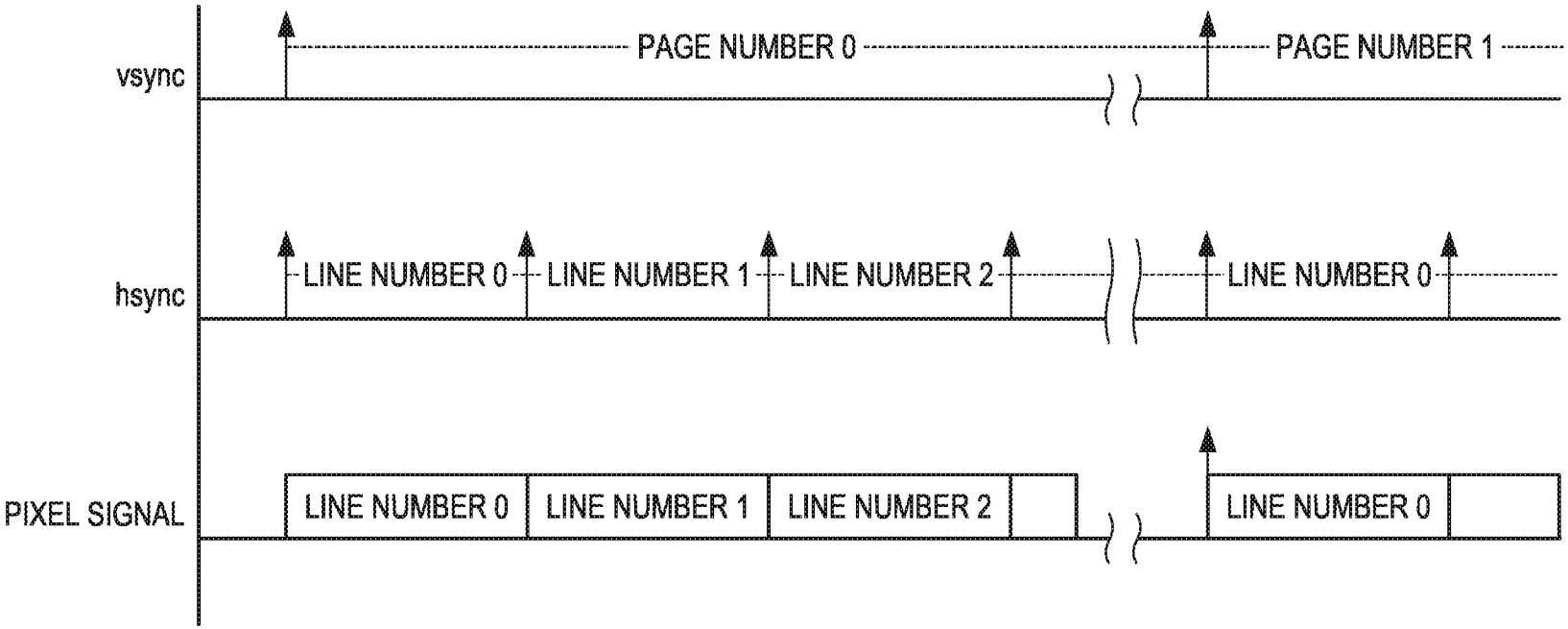
FIG. 4 shows a video signal.

A video signal waveform will be described with reference to FIG. 4. The video signal includes a vsync signal, an hsync signal, and a pixel signal. The vsync signal is a pulsed vertical synchronizing signal, and expresses a break of one page of an image. The hsync signal is a pulsed horizontal synchronizing signal, and expresses a break of one line of an image. That is, the vsync signal is output for each single page, and the hsync signal is output for each single line. The pixel signal holds density information of each pixel of image data.

A controller counter 305 has a line counter 306 that counts a line number of a video signal being output by the video ASIC 308, and a page counter 307 that counts a page number. The main CPU 301 refers to a count value of the controller counter 305, and decides a timing at which to reflect a control command to the PWM-IC 310. Also, the main CPU 301 may discriminate between a first face and a second face in duplex printing based on the count value of the page counter 307. Also, the main CPU 301 may discriminate between lines based on the count value of the line counter 306, or may discriminate between reflective faces of the polygonal mirror 204. When a pulse of the hsync signal occurs, the video ASIC 308 increments the line counter 306. When a pulse of the vsync signal occurs, the video ASIC 308 increments the page counter 307 and also clears (initializes) the line counter 306. By performing parallel/serial conversion of send data including a video signal and a control command from the video ASIC 308, a serial communication unit 309 generates a serial signal conforming with a communication standard of a serial communication line 330. Thus, the main CPU 301, the video ASIC 308, and the serial communication unit 309 function as a sending unit that sends each of a plurality of commands stored in a storage unit, according to an order of earliest to latest execution timing, through a serial communication line.

The PWM-IC 310 is connected to the controller 300 by a communication line, and is one example of a second control unit that controls the light source 201 according to a video signal received from the controller 300. For example, the PWM-IC 310 converts a video signal to be sent from the video ASIC 308 to a PWM signal, and supplies the PWM signal to a laser diode (LD) of the light source 201. The PWM-IC 310 is included in the laser scanner control unit 208. The PWM-IC 310 is divided by color, and performs control of an LD responsible for each respective color. Here, as a representative example, a PWM-IC 310 for yellow (Y) is described.

A sub-CPU 311 is a processor that interprets a control command received from the controller 300 through a serial communication unit 317, and executes processing corresponding to the control command. A RAM 312 provides a work memory of the sub-CPU 311. The serial communication unit 317 separates the control command and the video signal by performing parallel/serial conversion of a serial signal received from the controller 300, then stores the control command in a receive buffer 313 and outputs the video signal to a PWM control unit 318.

The receive buffer 313 is a storage apparatus that temporarily holds the control command received from the controller 300 until the control command is read out by the sub-CPU 311. The PWM control unit 318 generates a PWM signal in which a duty ratio changes according to the contrast of pixels indicated by the video signal, and outputs the PWM signal to the light source 201. The laser power of the laser diode is adjusted by a change in the duty ratio.

A PWM-IC counter 314 has a line counter 315 that counts a line number of the video signal, and a page counter 316 that counts a page number. The sub-CPU 311 uses a count value of the line counter 315 and a count value of the page counter 316 to determine a timing at which to reflect a control command. Similar to the controller counter 305, the PWM-IC counter 314 is incremented by the PWM control unit 318 in synchronization with the hsync signal and the vsync signal included in the video signal. When a pulse of the hsync signal occurs, the PWM control unit 318 increments the line counter 315. When a pulse of the vsync signal occurs, the PWM control unit 318 increments the page counter 316 and also clears (initializes) the line counter 315. A high-speed serial communication scheme conforming with the PCI-Express standard, for example, may be adopted in the serial communication line 330. The serial communication line 330 includes two communication lines for one PWM-IC 310, and one of those communication lines is a differential signal line.

Control Command Structure

FIG. 5A shows the structure of a control command. Various control parameters are included in a control command 500. A reflection page 501 indicates a page where the control command is to be reflected (executed). A reflection line 502 indicates a line where the control command is to be reflected (executed). Thus, the reflection page 501 and the reflection line 502 define a timing for reflecting the control command. The sub-CPU 311 compares the count value of the PWM-IC counter 314 to these control parameters, and decides a timing where the line number matches the page number as the timing for reflecting the control command. A control target 503 indicates a control target where the control command is to be reflected at the reflection timing. A control content 504 indicates a control value applied to the control target.

The main CPU 301, when issuing a control command of a line unit, inputs the count value of the page counter 307 to the reflection page 501, and inputs a line number for which the control command is intended to be reflected to the reflection line 502. On the other hand, the main CPU 301, when issuing a control command of a page unit, inputs the page number for which the control command is intended to be reflected to the reflection page 501, and inputs 0 to the reflection line 502. Page unit processing is processing intended to be reflected from the head line of that page. Accordingly, a control command is generated that is to be reflected in a line number 0, which is the head line of that page.

The main CPU 301 issues a control command by loading a control value that was calculated from image forming conditions or the like onto control content. Because a control command is issued asynchronously for each control content, a control command that was issued first is not necessarily to be reflected first.

In the present exemplary embodiment, the reflection page 501 and the reflection line 502 are loaded on a control command as information indicating the timing (execution timing) for reflecting the control command. Thus, the main CPU 301 specifies a control command that needs to be sent first among the plurality of control commands that are accumulated in the send buffer 304.

FIG. 5B shows exemplary control commands issued by the main CPU 301 when the count value of the controller counter 305 indicates a second page. In a control command 611 that was issued first, the reflection page 501 is set to the second page, the reflection line 502 is set to a 200th line, the control target 503 is set to a main scanning magnification, and the control content 504 is set to 101%. In a control command 612 that was issued second, the reflection page 501 is set to a third page, the reflection line 502 is set to a 0 line, the control target 503 is set to the main scanning magnification, and the control content 504 is set to 98%. In a control command 613 that was issued third, the reflection page 501 is set to the second page, the reflection line 502 is set to a 150th line, the control target 503 is set to laser power, and the control content 504 is set to F0h.

Figure 6A:
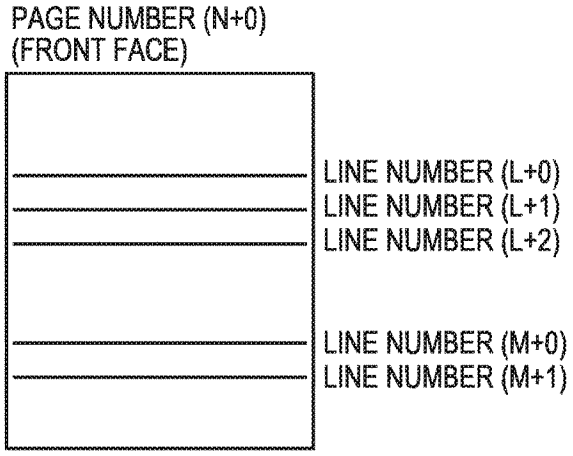
FIGS. 6A to 6C show a sending sequence of video signals and control commands.
Figure 6B:
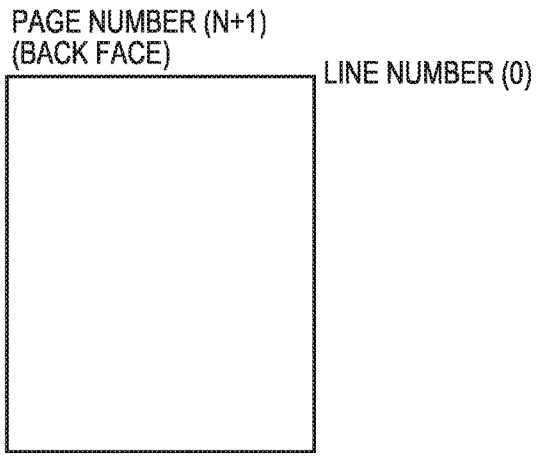
Figure 6C:
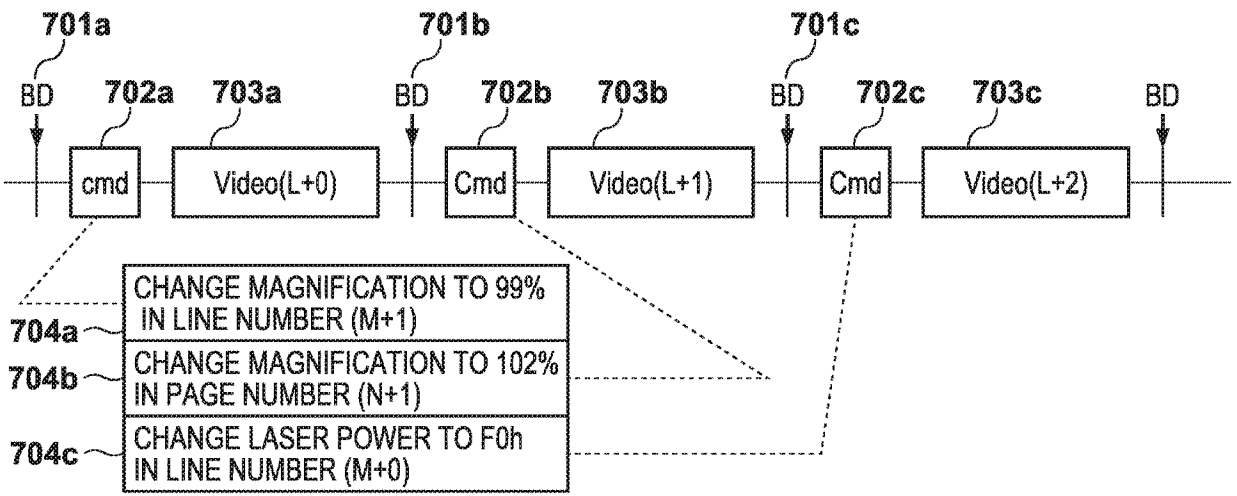

FIG. 6A shows render lines of a first face (front face) in a duplex printing mode. FIG. 6B shows render lines of a second face (back face) in the duplex printing mode. FIG. 6C shows video signals and control commands that the video ASIC 308 sends through the serial communication line 330 to the PWM-IC 310. N indicates a page number being output by the ASIC 308. L indicates a line number being output by the ASIC 308. M indicates a line in the same page as L, which is rendered after L. The video ASIC 308 outputs video signals 703*a*, 703*b*, and 703*c* having one line of image information respectively at timings 701*a*, 701*b*, and 701*c* when one BD pulse occurs. A send command 702*a* is sent in an interval from the BD pulse timing 701*a* to sending of the video signal 703*a*. A send command 702*b* is sent in an interval from the BD pulse timing 701*b* to sending of the video signal 703*b*. A send command 702*c* is sent in an interval from the BD pulse timing 701*c* to sending of the video signal 703*c*.

Issue commands 704*a*, 704*b*, and 704*c* are control commands that have been issued by the main CPU 301. The issue command 704*a* has control content of changing magnification to 99% in a line number (M+1). The issue command 704*b* has control content of changing magnification to 102% in a page number (N+1). The issue command 704*c* has control content of changing an adjustment value of the laser power to a value of F0h in a line number (M+0).

According to FIGS. 6A to 6C, the video ASIC 308 outputs video signals beginning from line number (L+0) of page number (N+0). The video signal 703*a* is a video signal of line number (L+0). The video signal 703*b* is a video signal of line number (L+1). The video signal 703*c* is a video signal of line number (L+2). The issue command 704*a* is assigned to the send command 702*a*. The issue command 704*b* is assigned to the send command 702*b*. The issue command 704*c* is assigned to the send command 702*c*. Thus, the issue command 704*a* has control content of a line (page) rendered after the line of the video signal 703*a*. The issue command 704*b* has control content of a line (page) rendered after the line of the video signal 703*b*. The issue command 704*c* has control content of a line (page) rendered after the line of the video signal 703*c*.

After storing the control commands in the send buffer 304, the main CPU 301 compares the reflection timing of the newly issued control commands to the reflection timing of control commands that have already been stored in the send buffer 304. The main CPU 301 sorts the plurality of control commands so as to be ordered from earliest to latest reflection timing. Thus, the video ASIC 308 is able to send the plurality of control commands in order according to their reflection timing. That is, a control command having an earlier reflection timing is sent before a control command having a later reflection timing.

Data Structure

Because the main CPU 301 calculates the plurality of control content asynchronously, the timing when control commands are created does not match the reflection timing of those control commands. That is, there may be instances where a first control command to be reflected earlier is issued later than a second control command, and the second control command to be reflected later is issued earlier than the first control command. Also, control commands are successively issued and added to the send buffer 304 as time passes. Accordingly, it is considered advantageous to use a linear list to which control commands can be easily added.

A linear list will be described with reference to FIG. 7. A linear list is a data structure in which a plurality of nodes where data and pointers are stored are linked with pointers. The main CPU 301 stores control commands in the send buffer 304 using a linear list 800. The linear list 800 has a header 801 expressing the head of the linear list 800. The header 801 is a pointer that points to a first node. Page nodes 802*a* and 802*b* gathering together control commands for each reflection page 501 are formed. Line nodes 804*a*, 804*b*, and 804*c* having control commands for each reflection line 502 are formed. Terminal nodes 803*a*, 803*b*, and 803*c* that express a terminal of a node are formed. The terminal nodes 803*a*, 803*b*, and 803*c* do not need to actually exist. Instead, NULL may be set in pointers that point to the terminal nodes 803*a*, 803*b*, and 803*c*. The page nodes 802*a* and 802*b*, and the line nodes 804*a* and 804*b*, respectively have a next pointer that expresses a next node.

Figure 7:
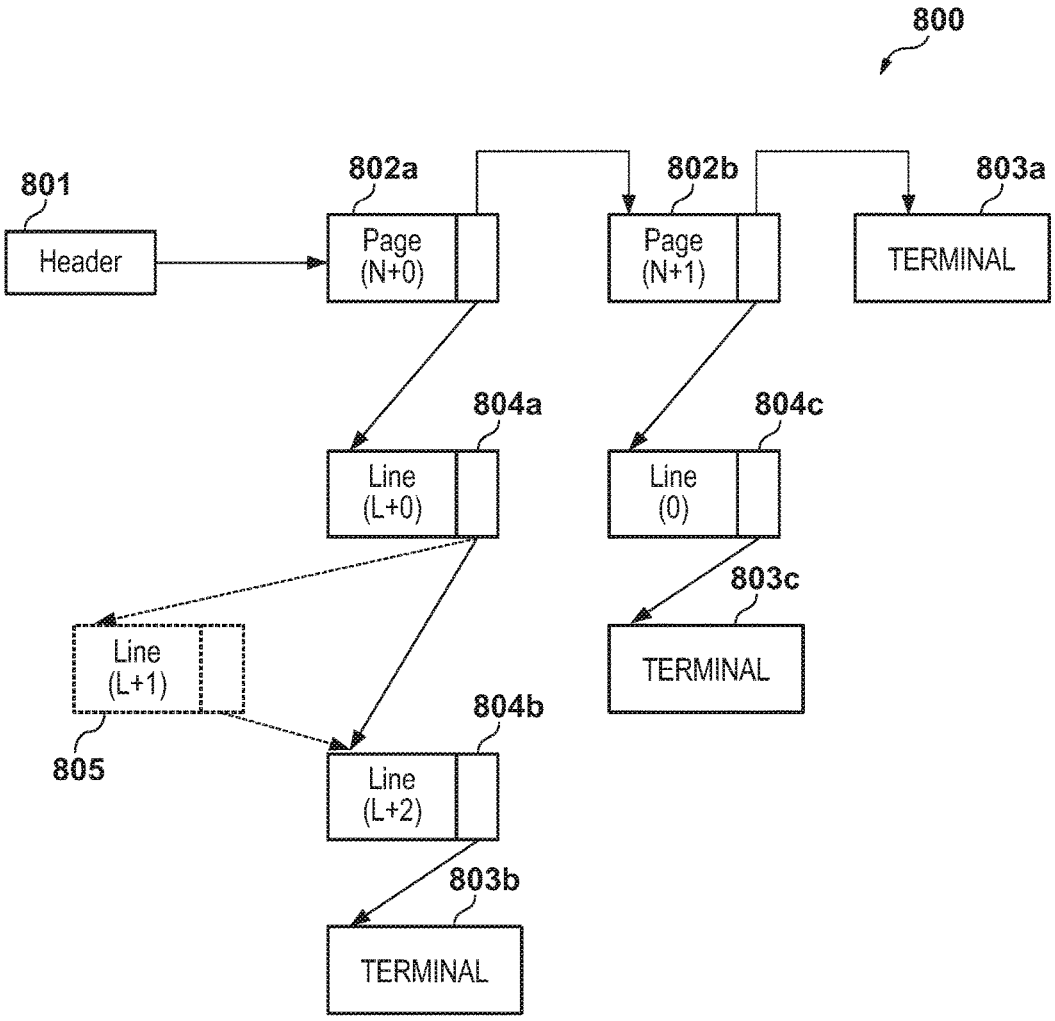
FIG. 7 shows a data structure for holding control commands.

According to FIG. 7, the page node 802*a* for gathering together control commands to be reflected in page number (N+0), and the page node 802*b* for gathering together control commands to be reflected in page number (N+1), are provided in the linear list 800. The page node 802*a* has the line node 804*a* storing control commands to be reflected in line number (L+0), and the line node 804*b* storing control commands to be reflected in line number (L+2). The page node 802*b* has the line node 804*c* storing control commands to be reflected in line number (0) of page number N+1.

Control Command Send Processing

Figure 8:
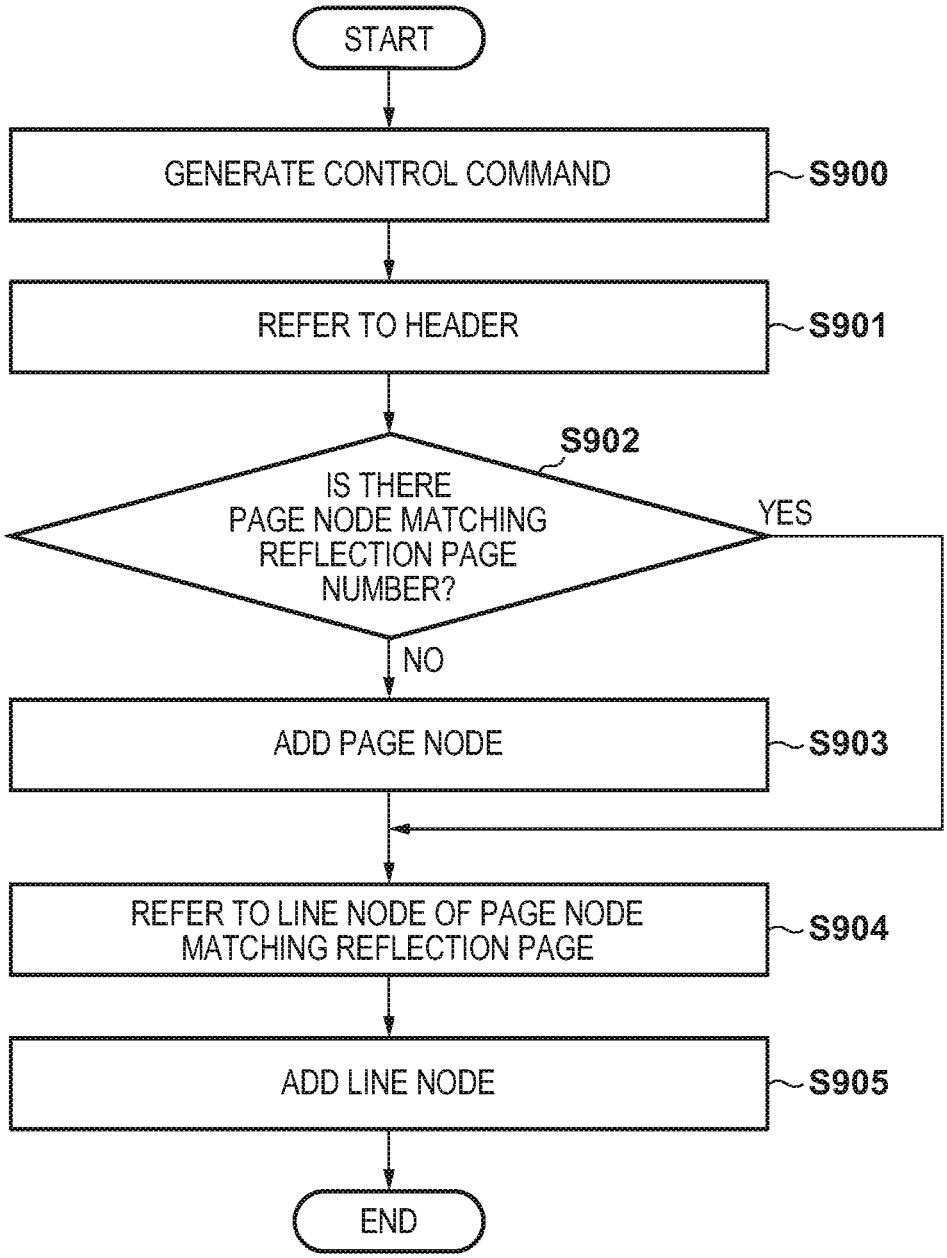
FIG. 8 is a flowchart showing control command sort processing.

FIG. 8 shows a flow of adding a control command to a linear list. In step S900, the main CPU 301 generates (issues) a control command. As for the control command generation technique itself, a publicly known technique can be adopted, so details of that technique will not be described here. In step S901, the main CPU 301 refers to the header 801, and acquires the reflection page 501 of the control command being stored by the send buffer 304. In step S902, the main CPU 301 searches for a page node matching the reflection page 501 of the issued control command, and determines whether or not there is a matching page node. If there is not a matching page node, the main CPU 301 proceeds to step S903. On the other hand, if there is a matching page node, the main CPU 301 skips step S903 and proceeds to step S904.

In step S903, the main CPU 301 adds a page node matching the reflection page 501 of the issued control command. In step S904, the main CPU 301 refers to the line nodes possessed by the page node matching the reflection page 501. The main CPU 301 compares the found line nodes to the reflection line 502 of the issued control command, and searches for a line node having a larger line number than the reflection line 502 of the control command.

In step S905, the main CPU 301 adds a line node for storing the issued control command before the line node that was found in step S904. That is, the main CPU 301 adds a node such that the respective line nodes are ordered with the reflection line 502 having the smallest line number.

As shown in FIG. 7, when the main CPU 301 issues a control command of line number (L+1) of page number (N+0), a line node 805 is added. That is, the main CPU 301 selects the page node 802*a* through steps S901 and S902. Further, by steps S904 and S905, the main CPU 301 adds the line node 805 related to line number (L+1) between the line node 804*a* related to line number (L+0) and the line node 804*b* related to line number (L+2). More specifically, the main CPU 301 changes the pointer of the line node 804*a* such that the pointer of the line node 804*a* points to the line node 805. Further, the main CPU 301 edits the pointer of the line mode 805 such that the pointer of the line node 805 points to the line node 804*b*.

When sending a control command to the PWM-IC 310 through the serial communication unit 309, the video ASIC 308 refers to the header 801 and sends the control command stored in the line node 804*a*, which is referred to initially. When the video ASIC 308 completes sending of the control command stored in the line node 804*a*, the main CPU 301 deletes the line node 804*a*. That is, the main CPU 301 edits the pointer of the page node 802*a* such that pointer of the page node 802*a* points to the line node 805. Note that when sending of control commands for all of the lines of page number (N+0) is completed, the main CPU 301 deletes the page node 802*a*. That is, the main CPU 301 edits the header 801 such that the header 801 points to the page node 802*b*, which is assigned to page number (N+1).

In this way, the main CPU 301 sorts a plurality of control commands in order from earliest to latest reflection timing, and stores them in the send buffer 304. Thus, the video ASIC 308 can send a control command having the earliest reflection timing among unsent control commands, merely by referring to a control command stored at the head of the send buffer 304 and sending this control command through the serial communication unit 309. Note that the serial communication unit 309 functions as a sending unit that sends each of a plurality of commands stored in the send buffer 304, according to an order of earliest to latest execution timing, through a communication line.

Control Command Execution Processing

The sub-CPU 311 receives a control command that was sent by the controller 300 through the serial communication unit 317, and stores the received control command in the receive buffer 313. Note that because a control command sent from the controller 300 is sorted according to execution timing and then sent, the serial communication unit 317 receives the control command according to the execution sequence. Also, a plurality of control commands are stored in the receive buffer 313 according to the execution sequence. The serial communication unit 317 functions as a receive unit that receives a video signal and a command through a communication line. At the BD pulse timing, the sub-CPU 311 refers to the control commands accumulated in the receive buffer 313, and executes a control command that needs to be reflected.

Figure 9:
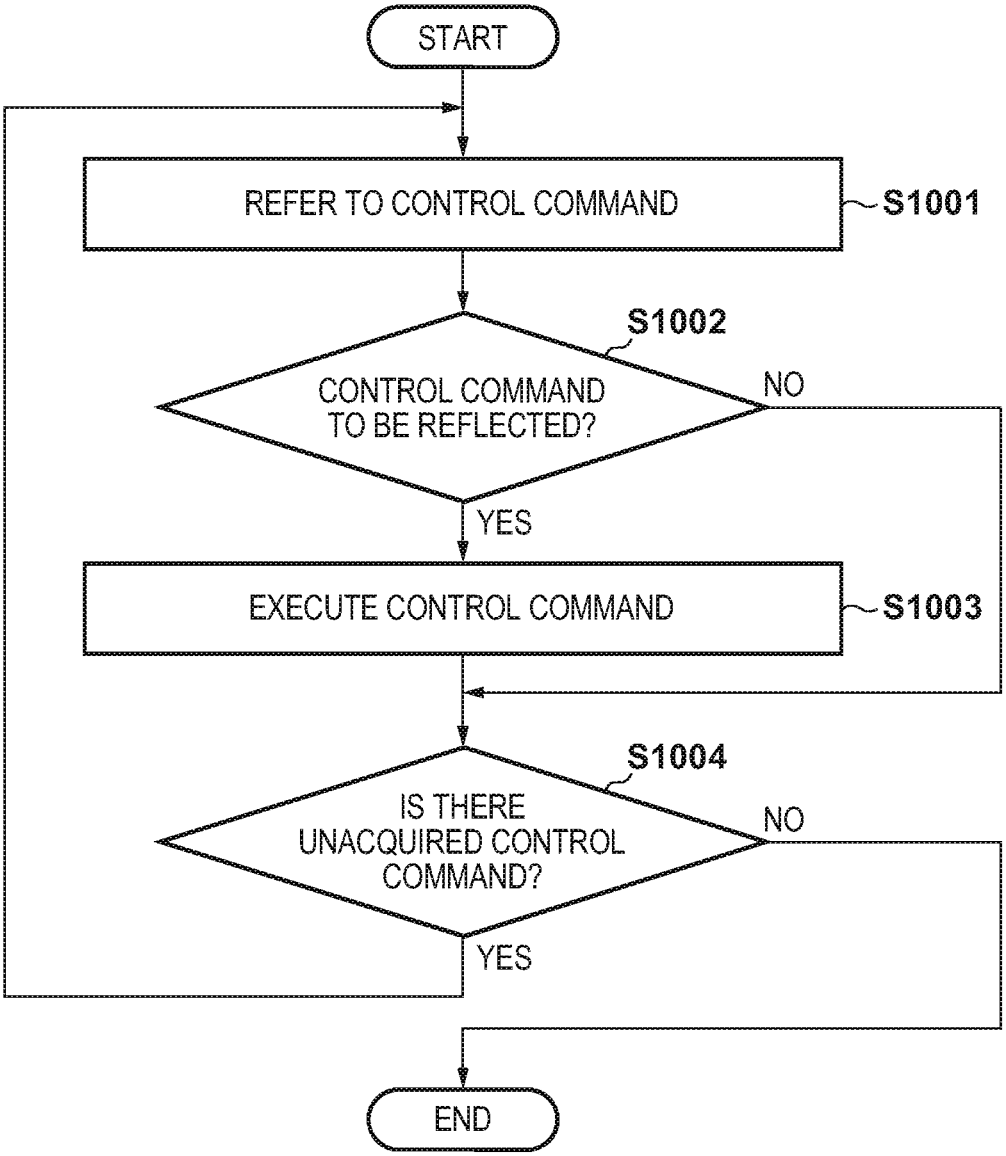
FIG. 9 is a flowchart showing control command execution processing.

FIG. 9 shows control command execution processing. In step S1001 the sub-CPU 311 refers to an unexecuted control command stored at the head of the receive buffer 313. In step S1002, the sub-CPU 311 determines whether or not the control command referred to is a control command to be reflected. For example, the sub-CPU 311 determines whether or not the reflection page 501 and the count value of the page counter 316 of the control command match, and determines whether or not the reflection line 502 and the count value of the line counter 315 of the control command match. If the control command referred to is a control command to be reflected, the sub-CPU 311 proceeds to step S1003. If the control command referred to is not a control command to be reflected, the sub-CPU 311 skips step S1003 and proceeds to step S1004.

In step S1003, the sub-CPU 311 executes the control command acquired in step S1001. Thus, the control content is reflected to the control target designated by the control command. For example, if the control target stored in the control command is laser power, and the control content is F0h, the sub-CPU 311 sets F0h as the laser adjustment value in the PWM control unit 318. The PWM control unit 318 applies the laser adjustment value of F0h, generates a drive signal (PWM signal), and supplies this drive signal to the light source 201. Note that the information indicating the control target may also include information indicating a laser diode, among a quantity K of laser diodes included in the light source 201, to which the control content applies. If the control target stored in the control command is the main scanning magnification, and the control content is 101%, the sub-CPU 311 sets a main scanning magnification of 101% in the PWM control unit 318. The PWM control unit 318 adjusts the length of the PWM signal per pixel such that the main scanning magnification is 101%. Thus, the PWM control unit 318 functions as a drive unit that generates a drive signal according to a video signal and a command that were received, and drives the light source 201. The sub-CPU 311 deletes the executed control command from the receive buffer 313.

In step S1004, the sub-CPU 311 determines whether or not there is an unexecuted control command remaining in the receive buffer 313. If there is an unexecuted control command remaining in the receive buffer 313, the sub-CPU 311 returns to step S1001, and refers to the next control command. On the other hand, if there is not an unexecuted control command remaining in the receive buffer 313, the sub-CPU 311 ends the control command execution processing. In this way, the sub-CPU 311 refers to all of the control commands stored in the receive buffer 313, and among those control commands, executes all of the control commands that need to be reflected at the present point in time.

Comparison of Embodiment and Comparative Example

Figure 10A:
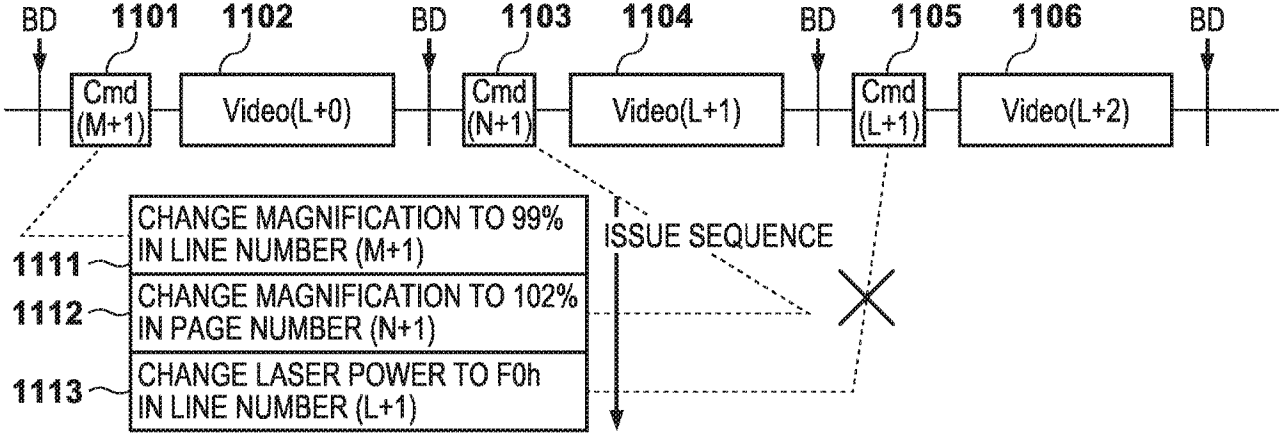
FIGS. 10A and 10B show an issue sequence and a send sequence of control commands.
Figure 10B:
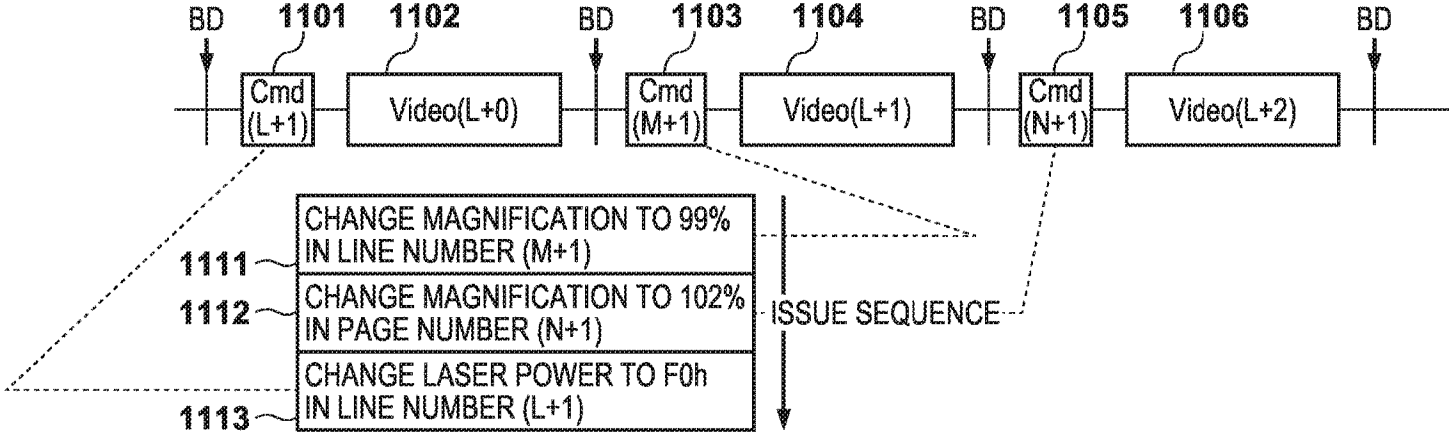

FIG. 10A illustrates an issue sequence and an execution sequence of control commands in a comparative example. FIG. 10B illustrates an issue sequence and an execution sequence of control commands in an embodiment. According to the comparative example and the embodiment, initially an issue command 1111 is issued, secondly an issue command 1112 is issued, and thirdly an issue command 1113 is issued. In the comparative example, initially a send command 1101 and a video signal 1102 are sent. Secondly, a send command 1103 and a video signal 1104 are sent. Thirdly, a send command 1105 and a video signal 1106 are sent.

In the comparative example, the send command 1105 is the issue command 1113 to be reflected in line number (L+1). However, the send command 1105 is sent at line number (L+2) later than the video signal 1104 of line number (L+1). Therefore, the PWM-IC 310 cannot reflect the issue command 1113 in time for line number (L+1).

On the other hand, in the present embodiment as shown in FIG. 10B, the issue command 1113, which has the earliest reflection timing among the issue commands 1111, 1112, and 1113, is assigned to the send command 1101, which is sent in line number (L+0). The issue command 1111 is assigned to the send command 1103, which is sent secondly. The issue command 1112 is assigned to the send command 1105, which is sent thirdly. The issue command 1113, which could not be sent in time for the reflection timing in the comparative example, is preferentially sent as a control command that needs to be reflected earliest. Therefore, the issue command 1113 can be transferred to the PWM-IC 310 by the time of the video signal 1104 of line number (L+1). In this way, in the present embodiment, even if control commands have been issued asynchronously for each control content, each control command is sent so as to be in time for their respective execution timing.

Summary

As described with reference to FIG. 3 and the like, the controller 300 that executes control related to a video signal is connected to the PWM-IC 310 that controls the light source 201 according to the video signal received from the controller 300 through the serial communication line 330. Note that a communication line other than the serial communication line 330 may also be adopted, as long as the plurality of control commands are transmitted in an order so as to be in time for their respective execution timing.

The main CPU 301 sends each of the plurality of commands stored in the send buffer 304 to the PWM-IC 310 according to an order of earliest to latest execution timing. The PWM control unit 318 of the PWM-IC 310 generates a drive signal to drive the light source 201 according to the video signals and the commands that were received. Thus, according to the present embodiment, the plurality of control commands can be transmitted in an order according to their respective execution timing.

As described with reference to FIGS. 7 and 8, the main CPU 301 functions as a sorting unit that sorts a plurality of control commands stored in the send buffer 304 according to an order of earliest to latest execution timing of each command. The video ASIC 308 and the serial communication unit 309 send the plurality of control commands that were sorted by the main CPU 301 according to an order of earliest to latest execution timing of each command. In this way, the main CPU 301 sorts each command according to an order of earliest to latest execution timing. Therefore, the command having the earliest execution timing can be sent to the PWM-IC 310 merely by the video ASIC 308 extracting a head control command stored in the send buffer 304.

As described with reference to FIG. 7, each time the main CPU 301 newly generates a control command, the main CPU 301 compares the execution timing of the new control command to the execution timing of the control commands stored in the send buffer 304. The main CPU 301 sorts these control commands in an order of earliest to latest execution timing. Thus, the plurality of control commands are stored in the send buffer 304 according to the order of their execution timing. As described with reference to FIG. 5A, the execution timing of control commands may also be defined according to pages or lines. Also, a control command itself may include discrimination information indicating a page and a line where the command is to be executed, and control content of the command.

As described with reference to FIG. 2, the BD sensor 207 functions as a detection unit that, in each single scan of a light beam, detects that light beam and outputs a detection signal (a BD signal). As described with reference to FIG. 6C, the serial communication unit 309 sends commands and video signals of one line each time the BD sensor 207 outputs a detection signal.

The line counter 306 is a counting unit that counts the number of a line being scanned by the laser scanner 102. A configuration may also be adopted in which the serial communication unit 309 reads out from the send buffer 304 and sends, among the plurality of commands stored in the send buffer 304, a command that is to be applied to a line having a later number than the number counted by the line counter 306 and having an earliest number. Note that in a case where in one scan period, first a control command is sent, and afterward in this scan period a video signal of a line to be scanned is sent, a control command to be applied to a line having the same number as the number counted by the line counter 306 may be read out. One scan period is a period from a pulse of a BD signal to the next pulse. The line counter 306 is incremented each time a BD signal pulse is input. One scan period includes a non-image period and an image period. In a case where a control command is sent in a non-image period, and a video signal is sent in an image period that occurs after the non-image period, it is sufficient that a control command that needs to be applied in the image period is transferred prior to the start of this image period. Accordingly, a control command having the same line number as the line number indicated by the line counter 306 may be sent.

The sub-CPU 311 and the PWM control unit 318 may function as a determination unit that determines whether or not the value of the reflection line 502 is specific discrimination information (0), which is discrimination information indicating a line included in a command. As described with reference to FIG. 5B, the sub-CPU 311 may apply control commands to all of the lines that constitute one page when the value of the reflection line 502 is 0. In this way, the present embodiment is also applicable to control commands applied in page units, rather than line units.

As described with reference to FIGS. 7 and 8, the main CPU 301 may also function as a creation unit that creates a linear list for managing the execution timing of each of a plurality of control commands stored in the send buffer 304. A linear list is a data structure capable of storing a plurality of control commands. As described with reference to FIG. 7, the linear list 800 may have a header indicating the head of the linear list, page nodes that gather together commands for each page, and line nodes that gather together commands for each line. Each page node has a pointer that indicates the next page node. Each line node has a pointer that indicates the next line node. The send buffer 304 stores a plurality of commands according to the linear list. In this way, a data structure such as a linear list may be adopted. As described with reference to FIG. 8, when a new command is generated, the main CPU 301 searches in the linear list for a page node matching a page where that command is to be applied. Further, if a page node matching the page of the new command does not exist, the main CPU 301 may add a new page node to the linear list 800. The main CPU 301 adds a new line node at a position corresponding to a line where the new command is to be applied in the new page node that was added. On the other hand, if a page node matching the page of the new command does exist, the main CPU 301 may trace that page node and add a new line node at a position corresponding to the line where the new command is to be applied. The linear list is a data structure in which nodes can be freely added or deleted, and therefore can be considered a data structure advantageous for holding control commands generated independently of their execution sequence, sorted according to their execution sequence.

The controller 300 and the PWM-IC 310 may also communicate by a serial communication scheme. High-speed communication is easily realized with a serial communication scheme, so even if a large quantity of laser diodes are included in the light source 201, control commands related to all of the laser diodes are easily transferred at high speed.

As described with reference to FIG. 6C and the like, the serial communication unit 309 sends video signals in an image period where the laser scanner 102 scans the photosensitive drum 103 with a light beam, and sends commands in a non-image period where the laser scanner 102 does not scan an image carrier with a light beam. In this way, in a case where the serial communication line 330 is used for both video signals and control signals, the time period in which control signals can be sent through the serial communication line 330 is restricted. Thus, by sorting a plurality of control signals according to execution timing, it is possible to send each control signal so as to be in time for their respective execution timing.

The control parameters transmitted by a command may include, for example, at least one among a light beam light amount (laser power), a shading correction amount at each light beam scanning position, and a main scanning magnification. Note that these control parameters are only examples, and other control parameters may also be adopted. The image forming apparatus 100 may also be a multicolor image forming apparatus that forms an image using toner of N colors (for example, four colors of YMCK). As described with reference to FIG. 3, the light source 201, the laser scanner 102, the photosensitive drum 103, and the PWM-IC 310 are provided for each of the N colors. When, in this way, image forming units are provided according to the quantity of toner colors, the quantity of control commands transferred by serial communication is a multiple of N. Accordingly, a conflict in send timing between a plurality of control commands easily occurs. According to the present embodiment, the plurality of control commands are sorted in advance according to their execution timing (reflection timing) and stored in the send buffer 304, so each control command is sent so as to be in time for their respective execution timing.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-209178, filed Oct. 23, 2015 which is hereby incorporated by reference herein in its entirety.

What is claimed is:

1. An image forming apparatus, comprising:

a light source;

an image carrier;

a scanning unit configured to deflect a light beam output from the light source such that the light beam scans the image carrier;

a first control unit configured to execute control related to a video signal; and a second control unit connected to the first control unit by a communication line, and configured to control the light source according to a video signal received from the first control unit;

the first control unit having:

a video signal generation unit configured to generate a video signal according to image information, a command generation unit configured to generate a command for transmitting a control parameter used to control the light source, a storage unit configured to store a command generated by the command generation unit, and a sending unit configured to send each of a plurality of commands stored in the storage unit according to an order of earliest to latest execution timing through the communication line, and the second control unit having:

a receiving unit configured to receive the video signal and the command through the communication line, and a drive unit configured to generate a drive signal according to the video signal and the command received by the receiving unit and drive the light source, wherein the image forming apparatus further comprises:

a sorting unit configured to sort a plurality of commands stored in the storage unit according to an order of earliest to latest execution timing of each command, wherein the sending unit sends the plurality commands sorted by the sorting unit.

2. The image forming apparatus according to claim 1, wherein the sorting unit, by comparing, each time the command generation unit generates a new command, the execution timing of the new command to the execution timing of commands stored in the storage unit, and sorting in an order of earliest to latest execution timing, stores a plurality of commands in the storage unit according to the order of execution timing.

3. The image forming apparatus according to claim 1, wherein the execution timing of the command is defined by a page and a line.

4. The image forming apparatus according to claim 3, wherein the command includes discrimination information indicating the page and the line where the command is to be executed, and control content of the command.

5. The image forming apparatus according to claim 3, further comprising a detection unit configured to, in each single scan of the light beam, detect the light beam and output a detection signal, wherein the sending unit sends a command and a video signal of one line each time the detection unit outputs the detection signal.

6. The image forming apparatus according to claim 3, further comprising a counting unit configured to count a line number being scanned by the scanning unit, wherein the sending unit reads out from the storage unit and sends, among the plurality of commands stored in the storage unit, a command applied to a line having the same number as the number counted by the counting unit, or a line having a later number than the number counted by the counting unit and that has an earliest number.

7. The image forming apparatus according to claim 3, further comprising a determination unit configured to determine whether or not discrimination information indicating a line included in the command is specific discrimination information, wherein when the discrimination information indicating a line included in the command is the specific discrimination information, the command is applied to all lines constituting one page.

8. An image forming apparatus, comprising:

a light source;

an image carrier;

a scanning unit configured to deflect a light beam output from the light source such that the light beam scans the image carrier;

a first control unit configured to execute control related to a video signal; and a second control unit connected to the first control unit by a communication line, and configured to control the light source according to a video signal received from the first control unit;

the first control unit having:

a video signal generation unit configured to generate a video signal according to image information, a command generation unit configured to generate a command for transmitting a control parameter used to control the light source, a storage unit configured to store a command generated by the command generation unit, and a sending unit configured to send each of a plurality of commands stored in the storage unit according to an order of earliest to latest execution timing through the communication line, and the second control unit having:

a receiving unit configured to receive the video signal and the command through the communication line, and a drive unit configured to generate a drive signal according to the video signal and the command received by the receiving unit and drive the light source, wherein the image forming apparatus further comprises:

a creation unit configured to create a linear list that stores a plurality of commands in the storage unit according to the execution timing of each command, the linear list having:

a header configured to indicate a head of the linear list, a page node configured to gather together commands of each page, and a line node configured to gather together commands of each line, each page node having a pointer configured to indicate a next page node, and each line node having a pointer configured to indicate a next line node, wherein the storage unit stores the plurality of commands according to the linear list.

9. The image forming apparatus according to claim 8, wherein the creation unit includes:

a unit configured to, when a new command is generated by the command generation unit, search in the linear list for a page node that matches a page where that command is to be applied;

a unit configured to determine whether or not a page node matching the page of the new command exists;

a unit configured to, if a page node matching the page of the new command does not exist, add a new page node to the linear list, and add a new line node at a position corresponding to a line where the new command is to be applied in the new page node; and a unit configured to, if a page node matching the page of the new command does exist, add a new line node at a position corresponding to a line where the new command is to be applied in the page node.

10. The image forming apparatus according to claim 1, wherein the first control unit and the second control unit communicate by a serial communication scheme.

11. The image forming apparatus according to claim 10, wherein the sending unit sends the video signal in an image period where the scanning unit scans the image carrier with the light beam, and sends the command in a non-image period where the scanning unit does not scan the image carrier with the light beam.

12. The image forming apparatus according to claim 1, wherein the control parameter transmitted by the command includes at least one among a light amount of the light beam, a shading correction amount at each scanning position of the light beam, and a scanning magnification.

13. The image forming apparatus according to claim 1, wherein the image forming apparatus is a multicolor image forming apparatus configured to form an image using toner of N colors, and the light source, the scanning unit, the image carrier, and the second control unit are provided for each of the N colors.

* * * * *